US008702190B2

(12) United States Patent
Koseki

(10) Patent No.: US 8,702,190 B2
(45) Date of Patent: Apr. 22, 2014

(54) LIQUID JET HEAD, LIQUID JET APPARATUS, AND METHOD OF DRIVING A LIQUID JET HEAD

(75) Inventor: Osamu Koseki, Chiba (JP)

(73) Assignee: SII Printek Inc. (JP)

( * ) Notice: Subject to any disclaimer, the term of this patent is extended or adjusted under 35 U.S.C. 154(b) by 124 days.

(21) Appl. No.: 13/373,179

(22) Filed: Nov. 7, 2011

(65) Prior Publication Data

US 2012/0113174 A1 May 10, 2012

(30) Foreign Application Priority Data

Nov. 9, 2010 (JP) ..... 2010-251054

(51) Int. Cl.
*B41J 29/38* (2006.01)
*B41J 2/175* (2006.01)
*B41J 2/045* (2006.01)

(52) U.S. Cl.
USPC ..... 347/9; 347/20; 347/68; 347/84; 347/85

(58) Field of Classification Search
CPC ..... B41J 29/38; B41J 2/175; B41J 2/045
See application file for complete search history.

(56) References Cited

U.S. PATENT DOCUMENTS 5,828,295 A * 10/1998 Mittel et al. ..... 340/407.1
6,070,310 A * 6/2000 Ito et al. ..... 623/17.11
6,276,781 B1 * 8/2001 Hasegawa ..... 347/50
6,312,080 B1 * 11/2001 De Roos et al. ..... 347/14
6,364,444 B1 * 4/2002 Ota ..... 347/10
6,390,609 B1 5/2002 Shigemura et al. ..... 347/71
6,547,375 B2 * 4/2003 Isono et al. ..... 347/69
7,311,378 B2 * 12/2007 Fujimori et al. ..... 347/33
7,475,968 B2 * 1/2009 Watanabe et al. ..... 347/68
7,980,662 B2 * 7/2011 Matsumoto ..... 347/47

FOREIGN PATENT DOCUMENTS

| | | |
|---|---|---|
| EP | 0870616 | 10/1998 |
| EP | 2371548 | 10/2011 |
| JP | 06342946 | 12/1994 |
| JP | 2002355967 | 12/2002 |
| JP | 2006068970 | 3/2006 |
| WO | 94 26524 | 11/1994 |
| WO | 99 22939 | 5/1999 |

* cited by examiner

*Primary Examiner* — Manish S Shah
*Assistant Examiner* — Jeremy Delozier
(74) *Attorney, Agent, or Firm* — Adams & Wilks

(57) ABSTRACT

A liquid jet head has a piezoelectric, a pair of electrodes for applying an electric field, and a drive section for driving the piezoelectric body. The drive section drives the piezoelectric body by setting a voltage of one of the electrodes to a first low voltage having a relatively small absolute value, and by supplying a drive signal of one polarity to the other electrode. The driving section restores the piezoelectric body by setting the voltage of the one electrode to a high voltage having the same one polarity as the drive signal and having a relatively large absolute value, and by setting a voltage of the other electrode to a second low voltage having a relatively small absolute value. The drive section applies a voltage for generating an electric field exceeding a coercive field of the piezoelectric body to the pair of electrodes.

8 Claims, 5 Drawing Sheets

LIQUID JET HEAD, LIQUID JET APPARATUS, AND METHOD OF DRIVING A LIQUID JET HEAD

BACKGROUND OF THE INVENTION

1. Field of the Invention

The present invention relates to a liquid jet head and a method of driving a liquid jet head, in which liquid is discharged by utilizing slip deformation of a piezoelectric body in a thickness direction to instantaneously change the volume of small spaces loaded with liquid.

2. Description of the Related Art

In recent years, an ink jet system liquid jet head has been used for creating characters and graphics by discharging ink droplets onto a recording sheet or the like, or forming a pattern of a functional thin film by discharging a liquid material onto a surface of an element substrate. In the ink jet system, ink or a liquid material is supplied from a liquid tank to the liquid jet head through a supply tube, and the ink is loaded into small spaces formed in the liquid jet head. In response to a drive signal, the volume of the small spaces is instantaneously reduced by utilizing an electrostrictive effect of the piezoelectric body to discharge liquid droplets from nozzles communicating to the small spaces.

FIG. 6A is a schematic cross-sectional view of a shear-mode liquid jet head 100. A plurality of grooves are formed in a surface of a piezoelectric substrate 101, and upper openings of the grooves are closed by a cover plate 106 to form a plurality of channels. The plurality of channels include discharge channels 102 for discharging liquid and dummy channels 103 having no liquid loaded thereto, which are arranged alternately with each other. The piezoelectric substrate 101 is subjected to polarization processing in a direction perpendicular to the surface thereof. Therefore, partition walls 107 are each polarized in the direction perpendicular to the substrate surface as indicated by the arrows of FIG. 6A. Common electrodes 104 are disposed on two side surfaces of the partition walls 107 on the discharge channel 102 side, which sandwich the corresponding discharge channel 102. Drive electrodes 105 are disposed on two side surfaces of the partition walls 107 on the dummy channel 103 side, which sandwich the corresponding discharge channel 102. The common electrodes 104 and the drive electrodes 105 are formed on the partition walls 107 in a portion above substantially half the height of the partition walls 107.

The common electrodes 104 formed on the two side surfaces of the corresponding discharge channel 102 are connected in common to a GND through a wiring electrode together with the common electrodes 104 of the other discharge channels 102. The two drive electrodes 105 disposed on the side surfaces of the dummy channels 103 on the discharge channel 102 side, which are adjacent to both sides of the corresponding discharge channel 102, are short-circuited through a wiring electrode, and connected to a terminal T for inputting a drive signal. When the drive signal is supplied to the terminal T, an electric field is applied in a direction orthogonal to the polarization direction of the upper half of the two partition walls 107, and hence the respective partition walls 107 slip to be deformed in a thickness direction to instantaneously change the internal volume of the discharge channel 102. In this manner, the liquid such as ink loaded into the discharge channel 102 is discharged from a nozzle 108.

However, when the liquid jet head is used over a long period of time, the drive signal of the same polarity is constantly applied in the direction orthogonal to the polarization direction, resulting in degradation of polarization P of the partition walls 107. In addition, the history of the applied drive signals differs among the discharge channels 102, and accordingly the degradation state of the polarization P also differs among the discharge channels 102. FIG. 6B schematically illustrates the polarization states of the respective partition walls 107 of the liquid jet head 100 after the long-term use, which are indicated by the arrows. The degradation state of the polarization also differs among the respective partition walls 107. Therefore, when the liquid jet head 100 is used with no measure taken, the liquid discharge condition becomes uneven, and consequently the recording quality decreases.

Japanese Patent Application Laid-open No. Hei 6-342946 describes the method of restoring the piezoelectric element made of a piezoelectric material to be used for an actuator or the like. In the description, a pellet piezoelectric element made of lead zirconate titanate (PZT) having a thickness of 0.5 mm is used, and after driving the piezoelectric element 107 times, an electric field is applied in a direction opposite to that of the drive electric field at a temperature of from 100° C. to 150° C., which is lower than the Curie temperature. Accordingly, the charged sites arranged by the application of the drive voltage are dispersed and broken, and an internal field is eliminated, with the result that the electromechanical coupling factor Kp and the mechanical quality factor Qm of the piezoelectric element are equalized to those of an unused product before the endurance test. Further, in the description, by subjecting the sample to polarization processing, the displacement amount and the polarization amount with respect to the applied voltage can be recovered substantially to the same state as that of the unused product.

Japanese Patent Application Laid-open No. 2002-355967 describes the drive apparatus capable of controlling the displacement unevenness of the piezoelectric element to be used for the bending-mode liquid discharge head. This liquid discharge head has a unit structure in which a pressure chamber loaded with liquid such as ink, an oscillation plate formed of an insulating film and a lower electrode, which is disposed on the pressure chamber, and a piezoelectric element formed of a piezoelectric thin-film layer and an upper electrode, which is disposed on the oscillation plate, are laminated one on another. The drive apparatus generates a drive waveform for driving the liquid discharge head having a large number of the above-mentioned pressure chambers arranged in parallel. Further, the drive apparatus generates a waveform for eliminating a remanent polarization of the piezoelectric thin-film layer. The remanent polarization changes with a lapse of time to cause unevenness between the elements. Therefore, the remanent polarization is eliminated by applying the waveform for eliminating the remanent polarization to the piezoelectric element. The waveform for eliminating the remanent polarization has a period of the same polarity as that of the drive waveform for driving the piezoelectric element, and an immediately succeeding period of an opposite polarity to that of the drive waveform. In the period of the same polarity, there is maintained a voltage level for applying an electric field intensity exceeding a coercive field of the piezoelectric thin-film layer, while in the period in which the polarity is reversed to the opposite polarity, there is maintained a voltage level for substantially applying the coercive field of the piezoelectric body. By applying the waveform to the upper electrode formed on the piezoelectric thin-film layer, the remanent polarization of the piezoelectric thin-film layer is set to 0. Accordingly, the change of the remanent polarization with a lapse of time can be prevented. The waveform for eliminating the remanent polarization is applied to the piezoelectric element at a timing immediately after powering on the printer, before or after cleaning the surface of the head, when replacing the ink cartridge, after delivering the paper, or other such timing than when discharging the ink.

Japanese Patent Application Laid-open No. 2006-68970 describes a method of restoring the piezoelectric element, which is a further improvement of the waveform described in Japanese Patent Application Laid-open No. 2002-355967. Specifically, between the period of the same polarity as that of the drive waveform, in which the voltage level for generating an electric field equal to or larger than the coercive field is maintained, and the period of the opposite polarity to that of the drive waveform after the above-mentioned period, in which the voltage level for generating the coercive field or an electric field equal to or larger than the coercive field is maintained, there is inserted a period of the opposite polarity to that of the drive waveform, in which a voltage having the absolute value smaller than the above-mentioned voltage of the opposite polarity is applied. Accordingly, the loads on the drive circuit and the piezoelectric element due to the steep change in potential are reduced.

In recent years, there has been increasing a demand for high-density arrangement of the discharge channels. In the case of the shear-mode liquid jet head, in order to achieve the high-density arrangement of the channels, it is necessary to reduce the thickness of the partition walls for partitioning the channels and the width of the channels in consideration of the structure of the liquid jet head. When the thickness of the partition walls and the width of the channels are reduced, the electric field intensity for driving the partition walls increases, and the polarization rotates due to the electric field applied in the direction orthogonal to the polarization direction, which raises the risk of degradation. Therefore, there is a demand for an effective measure to restore the degraded polarization of the piezoelectric partition walls.

In the method of restoring the piezoelectric element described in Japanese Patent Application Laid-open No. Hei 6-342946, the voltage is applied in the direction opposite to that of the drive voltage, and the charged sites dispersed and arranged by the application of the drive voltage are broken, to thereby eliminate the internal field due to the charged sites. In other words, because the charged sites need to be moved, the piezoelectric element is heated to the temperature of from 100° C. to 150° C. and the counter voltage is applied. When this restoration method is applied to the liquid jet head, there arises a need to separate and remove the piezoelectric element from the liquid jet head, or alternatively, there arises a need to heat the entire liquid jet head to 100° C. or higher, which complicates the restoration steps or disables the restoration steps from being carried out.

The piezoelectric element described in Japanese Patent Application Laid-open No. 2002-355967 or 2006-68970 is of the bending-mode type. Such a piezoelectric element has a structure different from that of the shear-mode type, and is driven by a different electric field. In Japanese Patent Application Laid-open No. 2002-355967 or 2006-68970, the piezoelectric thin-film layer has a thickness ranging from 1 μm to 3 μm, and the piezoelectric element is driven by an electric field sufficiently higher than the coercive field of the piezoelectric thin-film layer. In the shear-mode type, on the other hand, the piezoelectric body has a thickness at least one order of magnitude larger than that of the bending-mode type, and is subjected to the polarization processing. Such a piezoelectric element is driven by applying an electric field equal to or smaller than the coercive field. Accordingly, the degradation mode of the piezoelectric element is also different. In Japanese Patent Application Laid-open Nos. 2002-355967 and 2006-68970, the remanent polarization changes with a lapse of time, and the remanent polarization thus changed causes unevenness in the discharge condition. Therefore, the electric field of the same polarity as that of the drive waveform, which is at least twice as large as the coercive field, is first applied to the piezoelectric thin-film layer, and then the voltage of the opposite polarity, which is substantially equal to the coercive field, is applied, to thereby eliminate the remanent polarization that may cause the unevenness. In the shear-mode type, on the other hand, the piezoelectric body is polarized in advance, and slip deformation in the thickness direction is induced by applying the electric field in the direction orthogonal to the polarization direction. Therefore, when the remanent polarization is set to 0, the slip deformation in the thickness direction cannot be induced from the fact that the piezoelectric element is supposed to be driven by utilizing the remanent polarization. For this reason, the restoration method described in Japanese Patent Application Laid-open No. 2002-355967 or 2006-68970 cannot be applied to the shear-mode type.

Further, in Japanese Patent Application Laid-open Nos. 2002-355967 and 2006-68970, of the electrodes sandwiching the piezoelectric thin-film layer, the electrodes on one side are connected in common to be grounded, and the upper electrodes (individual electrodes) on the other side are individually connected to the drive circuit. To each of the upper electrodes, the drive voltage greatly exceeding the coercive field of the piezoelectric thin-film layer and the high reverse voltage having the polarity reverse to that of the drive voltage are applied. In other words, the drive circuit for driving the piezoelectric element needs to generate positive and negative high voltages, and hence the circuit structure is complicated, resulting in a large amount of load in constituting the liquid jet head.

SUMMARY OF THE INVENTION

The present invention has been made in view of the above-mentioned drawbacks in the conventional art, and it is therefore an object thereof to provide a liquid jet head and a method of driving the liquid jet head, which are capable of restoring a shear-mode piezoelectric element of the liquid jet head in a simple manner.

A liquid jet head of the present invention includes: a channel surrounded by wall members at least partially formed of a piezoelectric body that is subjected to polarization processing in one direction; a pair of electrodes sandwiching the piezoelectric body, for applying an electric field in a direction substantially orthogonal to the one direction; and a drive section for driving the piezoelectric body by setting a voltage of one of the pair of electrodes to a low voltage having a relatively small absolute value, and supplying a drive signal to another one of the pair of electrodes, in which the drive section includes a switching element for switching the voltage of the one of the pair of electrodes from the low voltage to a high voltage having a relatively large absolute value.

Further, the channel includes a discharge channel and a dummy channel, which are arranged in a substrate surface alternately with each other, the piezoelectric body forms at least part of a partition wall that spaces the discharge channel and the dummy channel apart from each other, the one direction includes a direction of a normal of the substrate surface, the one of the pair of electrodes comprises a common electrode disposed on a side surface of the partition wall on the discharge channel side, the another one of the pair of electrodes includes a drive electrode disposed on a side surface of the partition wall on the dummy channel side, and the drive section drives the partition wall by setting a voltage of a plurality of the common electrodes of a plurality of the discharge channels in common to the low voltage, and supplying the drive signal individually to the drive electrodes of a plurality of the dummy channels.

Further, the drive section applies an electric field exceeding a coercive field of the piezoelectric body to the partition wall between the common electrode and the drive electrode by controlling the switching element to set the voltage of the plurality of the common electrodes in common to the high voltage, and setting a voltage of the drive electrodes in common to the low voltage.

Further, the discharge channel is formed of an elongated groove having a width ranging from 30 μm to 50 μm, and a thickness of the partition wall in an arrangement direction in which the discharge channel and the dummy channel are arranged ranges from 30 μm to 50 μm.

Further, the switching element is constituted by a complementary circuit in which a P-channel field effect transistor and an N-channel field effect transistor are connected in series.

A liquid jet apparatus according to the present invention includes: any one of the above-mentioned liquid jet heads; a moving mechanism for reciprocating the liquid jet head; a liquid supply tube for supplying liquid to the liquid jet head; and a liquid tank for supplying the liquid to the liquid supply tube.

A method of driving a liquid jet head according to the present invention is a method of driving a liquid jet head including: a channel surrounded by wall members at least partially formed of a piezoelectric body that is subjected to polarization processing in one direction; a pair of electrodes sandwiching the piezoelectric body, for applying an electric field in a direction substantially orthogonal to the one direction; and a drive section for driving the piezoelectric body, the method including: driving, by the drive section, at a time of driving, the piezoelectric body by setting a voltage of one of the pair of electrodes to a first low voltage having a relatively small absolute value, and supplying a drive signal of one polarity to another one of the pair of electrodes; and restoring, by the drive section, at a time of restoration, the piezoelectric body by setting the voltage of the one of the pair of electrodes to a high voltage having the same one polarity as the drive signal and having a relatively large absolute value, and setting a voltage of the another one of the pair of electrodes to a second low voltage having a relatively small absolute value.

Further, the channel includes a discharge channel and a dummy channel, which are arranged in a substrate surface alternately with each other, the piezoelectric body forms at least part of a partition wall that spaces the discharge channel and the dummy channel apart from each other, the one of the pair of electrodes includes a common electrode disposed on a side surface of the partition wall on the discharge channel side, the another one of the pair of electrodes includes a drive electrode disposed on a side surface of the partition wall on the dummy channel side, and the method further includes: setting, by the drive section, at the time of driving, a voltage of a plurality of the common electrodes on the discharge channel side in common to the first low voltage, and supplying the drive signal individually to a plurality of the drive electrodes on the dummy channel side; and setting, by the drive section, at the time of restoration, the voltage of the plurality of the common electrodes on the discharge channel side in common to the high voltage, and setting a voltage of the plurality of the drive electrodes on the dummy channel side in common to the second low voltage.

The method further includes applying, by the drive section, at the time of restoration, a voltage for generating an electric field exceeding a coercive field of the piezoelectric body to the pair of electrodes.

According to the present invention, the liquid jet head includes: a channel surrounded by wall members at least partially formed of a piezoelectric body that is subjected to polarization processing in one direction; a pair of electrodes sandwiching the piezoelectric body, for applying an electric field in a direction substantially orthogonal to the one direction; and a drive section for driving the piezoelectric body by setting a voltage of one of the pair of electrodes to a low voltage having a relatively small absolute value, and supplying a drive signal to another one of the pair of electrodes, in which the drive section includes a switching element for switching the voltage of the one of the pair of electrodes from the low voltage having the relatively small absolute value to a high voltage having a relatively large absolute value. Accordingly, it is possible to provide the liquid jet head capable of suppressing the degradation of the piezoelectric body by applying the reverse voltage to the piezoelectric body without generating the positive and negative high voltages.

DETAILED DESCRIPTION OF THE PREFERRED EMBODIMENT

<Basic Structure>

Figure 1:
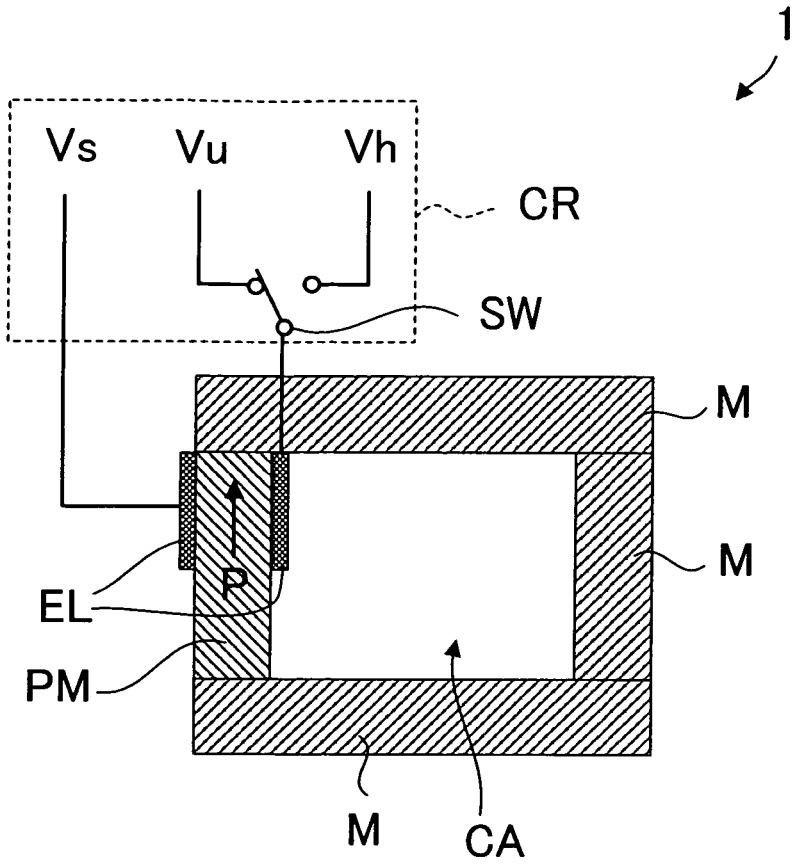
FIG. 1 is a conceptual diagram illustrating a basic structure of a liquid jet head according to the present invention.

FIG. 1 is a conceptual diagram illustrating a basic structure of a liquid jet head 1 according to the present invention. The liquid jet head 1 includes a channel CA, electrodes EL, and a drive section CR. The channel CA is surrounded by wall members M partially formed of a piezoelectric body PM that is subjected to polarization processing in one direction. The electrodes EL sandwich the piezoelectric body PM, and apply an electric field in a direction substantially orthogonal to the direction of polarization P of the piezoelectric body PM. The drive section CR sets a voltage of one of the pair of electrodes EL to a low voltage Vu having a relatively small absolute value, and supplies a drive signal Vs to the other, to thereby drive the piezoelectric body PM. The drive section CR includes a switching element SW for switching the voltage of the one of the pair of electrodes EL from the low voltage Vu to a high voltage Vh having a relatively large absolute value.

The piezoelectric body PM is subjected to the polarization processing in a direction parallel to a plate surface thereof. The pair of electrodes EL are disposed so as to apply the electric field in the direction substantially orthogonal to that of the polarization P of the piezoelectric body PM. When the drive section CR supplies the low voltage Vu to the one of the pair of electrodes EL and the drive signal Vs to the other, the piezoelectric body PM slips to be deformed in a thickness direction, and therefore the volume of the channel CA changes instantaneously. Accordingly, a pressure fluctuation is transmitted to the liquid loaded into the channel CA, and the liquid is discharged from a nozzle (not shown). Apart from this normal drive, the liquid jet head 1 according to the present invention includes the switching element SW provided to the drive section CR, to thereby switch the voltage of the one of the pair of electrodes EL from the low voltage Vu to the high voltage Vh. With this structure, it is possible to apply a restoration voltage for restoring the piezoelectric body by reversing the direction of the electric field.

When the drive signal Vs is applied to the piezoelectric body PM, the direction of the polarization P of the piezoelectric body PM changes in accordance with the history of the applied drive signal Vs. Therefore, an amount of the slip deformation of the piezoelectric body PM in the thickness direction becomes uneven in accordance with the drive history, with the result that the liquid discharge condition fluctuates. In the present invention, the drive section CR includes the switching element SW for switching between the low voltage Vu and the high voltage Vh, and accordingly it is possible to apply the restoration voltage as the high voltage allowing the direction of the electric field in the piezoelectric body PM to be reversed as compared to the normal drive. In this manner, the degradation of the piezoelectric body PM is suppressed, and even in a case where a large number of channels CA are arranged to constitute the liquid jet head, the unevenness in the discharge condition can be suppressed.

In FIG. 1, the piezoelectric body PM is provided as the left wall member forming the channel CA, and the pair of electrodes EL sandwiching the piezoelectric body are provided. Alternatively, the wall member M on a different side may be formed of the piezoelectric body PM, or the right and left wall members M, the upper and lower wall members M, or all the wall members M may be formed of the piezoelectric bodies PM each having the pair of electrodes EL disposed thereon. The pair of electrodes EL may be formed in a lower half region of the piezoelectric body PM in its longitudinal direction, instead of forming the pair of electrodes EL in an upper half region thereof. Further, instead of forming the entire wall member M of the piezoelectric body PM, part of the wall member M may be formed of the piezoelectric body PM. For example, part of the wall member M reaching half the height thereof may be formed of the piezoelectric body PM, and the other part of the wall member M ranging from half the height to the uppermost portion may be formed of a non-piezoelectric material. In this case, the pair of electrodes EL can be formed on both the entire side surfaces of the wall member M formed of the piezoelectric body PM. Further, any one of the wall members M may be formed of the piezoelectric body PM, and may be polarized in a downward direction or an upward direction in a portion below half the height thereof, while being polarized in the upward direction or the downward direction in a portion above half the height thereof, so that the pair of electrodes EL may be formed on both the entire side surfaces of the wall member M.

Next, description is given of a basic method of driving a liquid jet head according to the present invention. First, the liquid jet head includes: a channel surrounded by wall members at least partially formed of a piezoelectric body that is subjected to polarization processing in one direction; a pair of electrodes for applying an electric field in a direction substantially orthogonal to the above-mentioned polarization direction; and a drive section for driving the piezoelectric body. At the time of normal drive, the drive section sets a voltage of one of the above-mentioned pair of electrodes to a first low voltage having a relatively small absolute value, such as a ground potential, and supplies a drive signal of one polarity to another one of the pair of electrodes. At the time of restoration for suppressing the degradation of the piezoelectric body, the drive section restores the piezoelectric body by setting the voltage of the one of the pair of electrodes to a high voltage of the same one polarity as the polarity of the above-mentioned drive signal, the high voltage having a relatively large absolute value, and setting a voltage of the another one of the pair of electrodes to a second low voltage having a relatively small absolute value, such as the ground potential.

In this manner, the drive section applies, to the piezoelectric body, an electric field in one direction and an electric field in a reverse direction, which is reversed to the above-mentioned direction, without generating a voltage of another polarity in addition to the voltage of the one polarity. Thus, it is possible to perform restoration processing for the piezoelectric body without complicating the circuit structure of the drive section. Here, it is preferred that the drive signal Vs supplied to the piezoelectric body at the time of driving be a voltage that avoids exceeding a coercive field of the piezoelectric body. When a drive signal exceeding the coercive field of the piezoelectric body is applied at the time of driving, a polarization axis of the polarization P of the piezoelectric body rotates, and therefore the amount of the slip deformation in the thickness direction changes greatly. The drive signal Vs is set as above to prevent this effect. Further, it is preferred that the restoration voltage supplied to the piezoelectric body at the time of restoration be a voltage exceeding the coercive field of the piezoelectric body. The high voltage exceeding the coercive field of the piezoelectric body is applied to the piezoelectric body at the time of restoration in order to return the polarization direction that has rotated due to the drive signal to the initial state, or to return the polarization direction to a stable state close to the initial state. Hereinbelow, specific description is given with reference to the accompanying drawings.

<Embodiment>

Figure 2A:
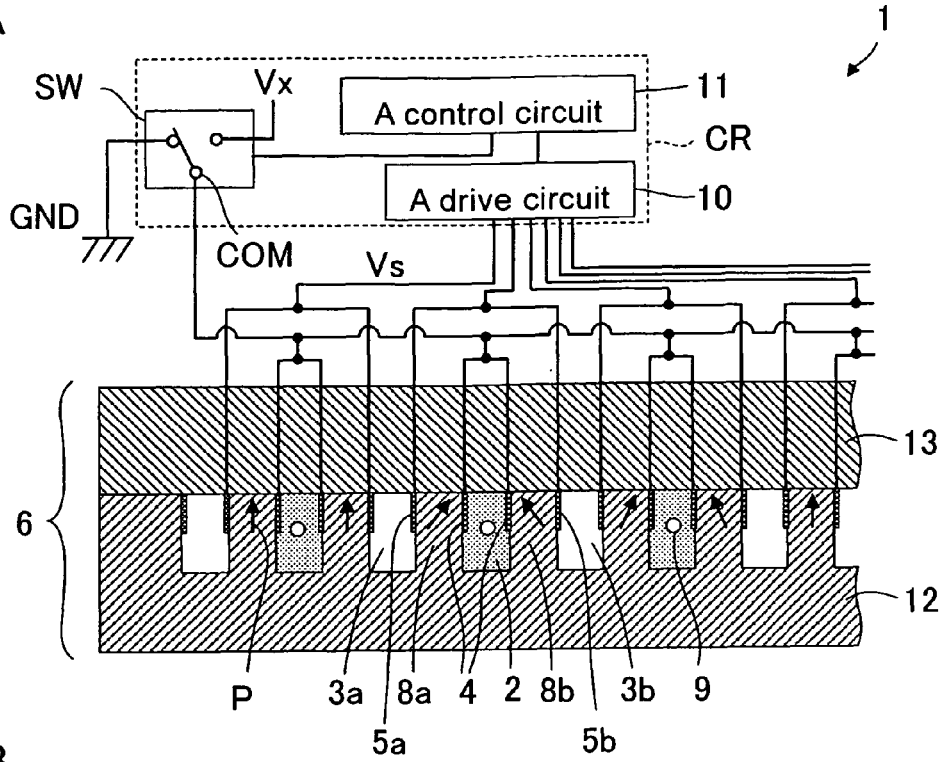
FIGS. 2A and 2B are explanatory diagrams illustrating the liquid jet head and a method of driving a liquid jet head according to an embodiment of the present invention.
Figure 2B:
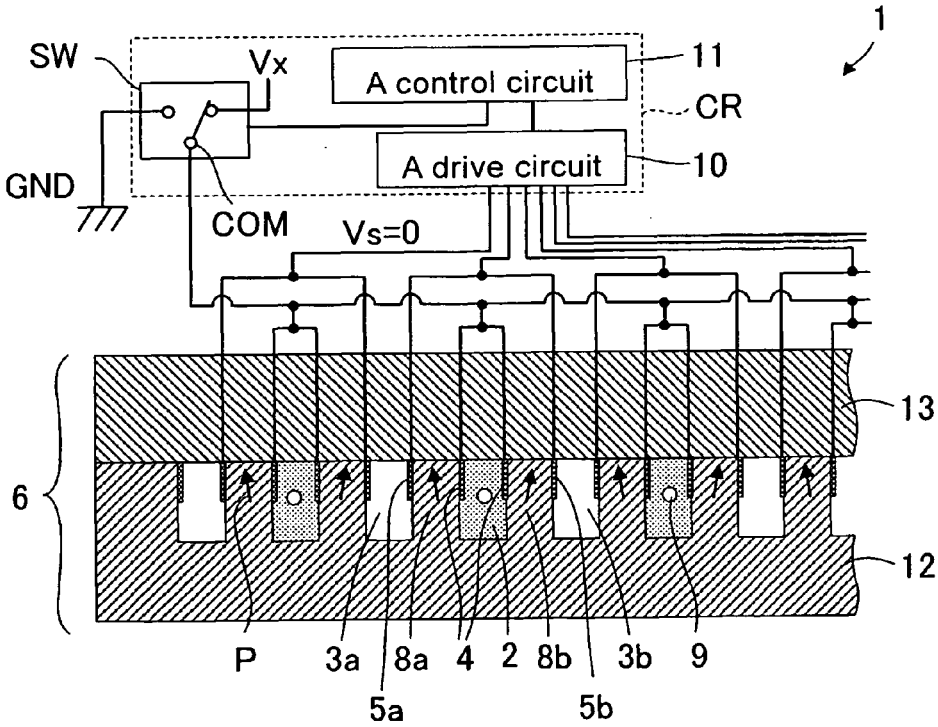

FIGS. 2A and 2B illustrate an embodiment of the present invention, specifically, FIGS. 2A and 2B are explanatory diagrams illustrating the liquid jet head 1 and the method of driving the liquid jet head 1 according to the present invention. FIG. 2A is a structural diagram illustrating a state at the time of normal drive, and FIG. 2B is a structural diagram illustrating a state at the time of restoration. The liquid jet head 1 includes a channel forming section 6 formed of an actuator substrate 12 and a cover plate 13, and the drive section CR for driving the channel forming section 6. The actuator substrate 12 is formed of a piezoelectric body, and includes a plurality of grooves arranged in parallel in a substrate surface thereof. The plurality of grooves have upper opening portions closed by the cover plate 13 to form discharge channels 2 and dummy channels 3. The discharge channels 2 and the dummy channels 3 are arranged alternately with each other. The discharge channels 2 communicate to nozzles 9 of a nozzle plate (not shown), and have a function of discharging liquid loaded into a chamber. The liquid is not supplied to the dummy channels 3, and hence the dummy channels 3 do not have the function of discharging the liquid.

The discharge channels 2 and the dummy channels 3 are spaced apart from each other through the intermediation of partition walls 8. The partition walls 8 are each formed of the piezoelectric body, and subjected to polarization processing in a direction of the normal of the substrate surface. Right and left partition walls 8*a* and 8*b* constituting the discharge channel 2 include common electrodes 4 disposed on the respective side surfaces on the discharge channel 2 side, and include a drive electrode 5*a* and a drive electrode 5*b* disposed on the respective side surfaces on a side of adjacent dummy channels 3*a* and 3*b*. The respective common electrodes 4 are electrically short-circuited through a wiring electrode, and the drive electrode 5*a* and the drive electrode 5*b* are electrically short-circuited through another wiring electrode. Therefore, by applying a drive signal between the drive electrode 5*a* and the common electrode 4 and between the drive electrode 5*b* and the common electrode 4, slip deformation in the thickness direction is induced in the partition walls 8*a* and 8*b*, respectively, and accordingly the volume of the discharge channel 2 is increased or decreased, with the result that the liquid loaded inside can be discharged from the nozzle 9.

The drive section CR includes: a control circuit 11 for controlling an operation of the liquid jet head 1; a drive circuit 10 for supplying the drive signal Vs to the drive electrodes 5*a* and 5*b* under the control of the control circuit 11; and the switching element SW for setting the voltage of the common electrodes 4 by switching the voltage to a ground potential of a GND or a restoration voltage Vx. The drive circuit 10 supplies the drive signal Vs individually to the drive electrodes 5*a* and 5*b* disposed on the side surfaces of the partition walls 8*a* and 8*b* constituting each discharge channel 2, which are situated on the side of the dummy channels 3*a* and 3*b*. The switching element SW is connected in common to the respective common electrodes 4 disposed on the side surfaces of the partition walls 8*a* and 8*b* constituting each discharge channel 2, which are situated on the discharge channel 2 side, to set in common the respective common electrodes 4 so as to have the ground potential as the low voltage. The control circuit 11 controls the drive of the drive circuit 10 and the drive of the switching element SW.

FIG. 2A illustrates the liquid jet head 1 that is used for a long period of time, and hence there is unevenness in the direction of the polarization P of the piezoelectric body situated in a region of each partition wall 8 which is sandwiched by the drive electrode 5 and the common electrode 4. The polarization P before the use is oriented to the direction of the normal of the surface of the actuator substrate 12. However, at the time of driving, the common electrodes 4 are set so as to have the ground potential, and the drive signal Vs is applied to the drive electrodes 5, with the result that the polarization axis of the polarization P rotates in accordance with the drive history of the drive signal Vs, and accordingly unevenness occurs in a rotational angle thereof. When the direction of the polarization P changes, the amount of the slip deformation in the thickness direction changes, which leads to unevenness in a liquid discharge rate.

FIG. 2B illustrates the state after the restoration processing is performed. The control circuit 11 controls the switching element SW and the drive circuit 10 to set in common the common electrodes 4 of the plurality of discharge channels 2 so as to have the restoration voltage Vx as the high voltage, and set in common the drive electrodes 5 situated on the side of the plurality of dummy channels 3 so as to have a voltage of 0 volts as the low voltage. In this case, it is preferred that the restoration voltage Vx be a voltage for generating an electric field exceeding the coercive field of the piezoelectric body forming each partition wall 8. In this manner, the polarization direction of the piezoelectric body forming each partition wall 8 can be aligned. The restoration voltage Vx may be applied so that the direction of the polarization P of the piezoelectric body is returned to the initial state, in which the direction is aligned to the direction perpendicular to the substrate surface. Alternatively, as illustrated in FIG. 2B, the restoration voltage Vx may be applied to the extent that the direction of the polarization P is inclined in a direction opposite to the rotation direction, in which the polarization P rotates due to the drive signal Vs. Specifically, when the polarization axis of the polarization P rotates clockwise in the left partition wall 8*a* and counterclockwise in the right partition wall 8*b* due to the drive of the drive signal Vs, the restoration voltage Vx is applied to the extent that the polarization axis in the left partition wall 8*a* is rotated counterclockwise by a small angle of $-d\theta$ with respect to the initial polarization direction (direction of the normal of the substrate surface), and that the polarization axis in the right partition wall 8*b* is rotated clockwise by a small angle of $+d\theta$ with respect to the initial polarization direction. In this manner, the respective discharge channels 2 can be restored to have a uniform discharge characteristic independent of the drive history.

More specific description is given below. As the actuator substrate 12 formed of the piezoelectric body, there is used a lead zirconate titanate (PZT) ceramics subjected in advance to polarization processing in the direction of the normal of the substrate surface.

The width of each discharge channel 2 is set to 75 μm, and the thickness of each partition wall 8 in the direction orthogonal to the channel arrangement direction is set to 65 μm. The common electrodes 4 or the drive electrodes 5 is formed by an oblique deposition method in a region above substantially half the height of each partition wall 8. The coercive field intensity of the piezoelectric body used ranges from 0.5 KV/mm to 0.6 KV/mm. Therefore, the voltage for generating the coercive field intensity ranges from 32.5 V to 39 V. At the time of driving, the control circuit 11 controls the switching element SW to connect a COM terminal, which is connected to each common electrode 4, to the GND, and controls the drive circuit 10 to supply, to the drive electrodes 5 corresponding to each discharge channel 2, a voltage that avoids exceeding the above-mentioned coercive field intensity, for example, the drive signal Vs of 20 V to 25 V. Specifically, the drive signal Vs is about 60% to 70% of the voltage for applying the coercive field. At the time of restoration, on the other hand, the control circuit 11 controls the drive circuit 10 to simultaneously set the respective drive electrodes 5 so as to have a GND potential, and controls the switching element SW to set the COM terminal connected to each common electrode 4 so as to have the restoration voltage Vx. Such a state is maintained for, for example, 1 second to several seconds. The restoration voltage Vx is set to the voltage exceeding the above-mentioned coercive field intensity.

Further, in accordance with a demand for high-density arrangement of the discharge channels, the width of each discharge channel 2 may be set to 30 μm to 50 μm, and the thickness of each partition wall 8 in the direction orthogonal to the arrangement direction of the discharge channels 2 and the dummy channels 3 may be set to 30 μm to 50 μm. For example, the same material of the piezoelectric body as described above is used, and the width of each discharge channel is set to 40 μm, while the thickness of each partition wall 8 is set to 45 μm. In this case, the voltage for generating the coercive field intensity is decreased to 22.5 V to 27 V. However, the voltage of the drive signal Vs does not decrease proportionally to the thickness of each partition wall 8, and a voltage of about 20 V to 22 V is necessary, for example. Accordingly, the drive signal Vs is as high as about 75% to 100% of the voltage for applying the coercive field, and the drive signal Vs at the time of normal drive approximates the coercive field intensity of each partition wall 8. As a result, the degradation of the partition wall 8 is likely to progress. However, by providing the switching element SW to the drive section CR to apply the reverse restoration voltage to the common electrodes 4 and the drive electrodes 5, the degraded polarization can be restored. Thus, the liquid jet head 1 having the discharge channels 2 arranged with high density can discharge the liquid uniformly among the respective discharge channels. The restoration voltage Vx is set to a voltage higher than the voltage for generating the above-mentioned coercive field intensity, for example, the voltage of 22.5 V to 27 V.

In the above-mentioned structure, the switching element SW is provided to the drive section CR so that the voltage of the common electrodes 4 of each discharge channel 2 is switchable from the GND to the high voltage as the restoration voltage Vx. Thus, the drive circuit 10 does not need to generate the restoration high voltage of a polarity reverse to that of the drive high voltage, and there is no need to build a sophisticated and complicated circuit in the drive section CR. Further, it is possible to restore the degraded polarization of each partition wall 8, and hence the partition wall 8 can be thinned, with the result that the discharge channels 2 can be arranged with high density. Note that, the restoration drive can be, for example, carried out at a regular timing when activating a liquid discharge apparatus having the liquid jet head 1 built inside, when cleaning the liquid jet head 1, or when the liquid jet head 1 does not perform the discharge operation, or alternatively, carried out in accordance with a cumulative drive period.

Further, in this embodiment, the restoration processing can be carried out not only when the liquid is not loaded into the respective discharge channels 2, but also when the liquid is loaded. Specifically, the voltage is applied to the common electrodes 4 of all the discharge channels 2 loaded with the liquid, which are held in contact with the liquid, and hence the common electrodes 4 of all the discharge channels 2 have the same potential. Therefore, no electric conduction occurs through the liquid, which prevents electrolysis of the liquid. Accordingly, the restoration processing can be carried out also when the liquid is loaded into the respective discharge channels 2.

In the above description, the piezoelectric body is used as the actuator substrate 12, but, for example, only the partition walls 8 may be formed of the piezoelectric body, and as the substrate holding those partition walls 8, a ceramic substrate made of an insulator and the like may be used, or other kinds of inorganic material or an organic material may be used.

Figure 3:
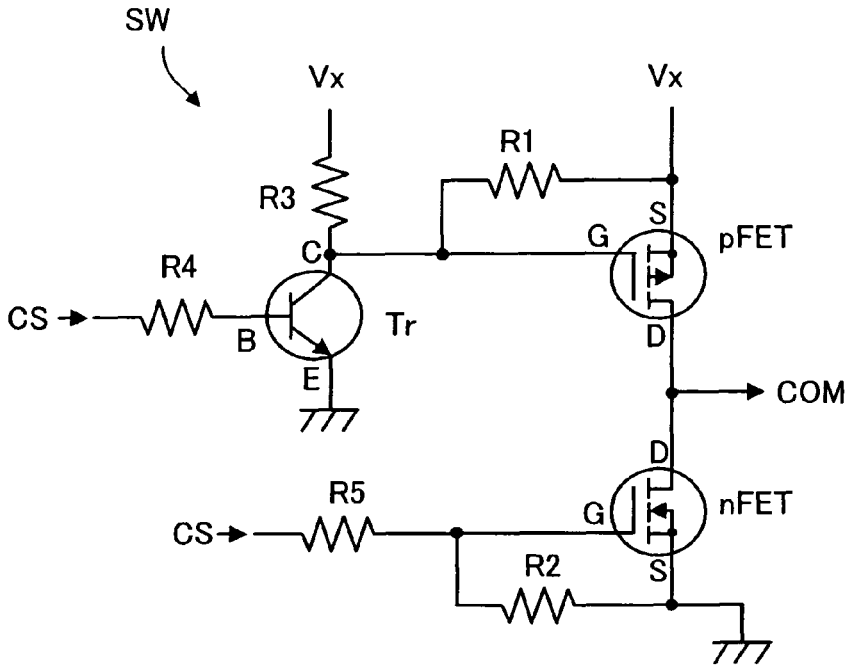
FIG. 3 is a circuit diagram of a switching element to be used for the liquid jet head according to the embodiment of the present invention.

FIG. 3 is a circuit diagram illustrating an example of the switching element SW to be used for the liquid jet head 1 according to the embodiment of the present invention. The switching element SW is constituted by a complementary circuit in which a P-channel field effect transistor (FET) (pFET) connected to the restoration voltage Vx as the high voltage and an N-channel FET (nFET) connected to the GND as the low voltage are connected in series, and the connection point therebetween is set as an output terminal. The restoration voltage Vx is input to a source S of the P-channel FET, a source S of the N-channel FET is connected to the GND, and a drain D of the P-channel FET and a drain D of the N-channel FET are connected to an output terminal COM. A control signal CS is input from the control circuit 11 to a gate G of the P-channel FET through an npn-type transistor Tr for adjusting an ON voltage. The control signal CS is input from the control circuit 11 to a gate G of the N-channel FET through a resistor R5. A collector C of the transistor Tr is connected to the gate G of the P-channel FET, and the restoration voltage Vx is input to the collector C through a resistor R3. An emitter E of the transistor Tr is connected to the GND, and the control signal CS is input to a base B of the transistor Tr through a resistor R4. The gate G and the source S of the P-channel FET are connected to each other through a resistor R1, and the gate G and the source S of the N-channel FET are connected to each other through a resistor R2.

This circuit operates as follows. When the control signal CS at H level is input from the control circuit 11, the transistor Tr having the base B at L level is turned OFF, the gate G of the P-channel FET becomes a Vx level, and the source S and the drain D of the P-channel FET are disconnected from each other. Meanwhile, the N-channel FET having the gate G to which the control signal CS at H level is input is turned ON, and the drain D and the source S become a connected state therebetween.

As a result, the output terminal COM is connected to the GND. Such a state is the normal drive operation state. When the control signal CS at L level is input from the control circuit 11, the transistor Tr having the base B at L level is turned ON, the gate G of the P-channel FET becomes a GND level, and the source S and the drain D of the P-channel FET become a connected state therebetween. Meanwhile, the N-channel FET having the gate G to which the control signal CS at L level is input is turned OFF, and the source S and the drain D are disconnected from each other. As a result, the restoration voltage Vx is supplied to the output terminal COM. Such a state is the restoration operation state.

As described above, the complementary circuit including the N-channel FET and the P-channel FET only needs to be added as the switching element SW, and there is no need to form a complicated drive circuit. Note that, the switching element SW is not limited to the circuit structure of FIG. 3, and the point is that the switching element SW is adapted to switch the voltage of the common electrodes 4 between the GND level as the low voltage and the restoration voltage Vx as the high voltage.

Figure 4:
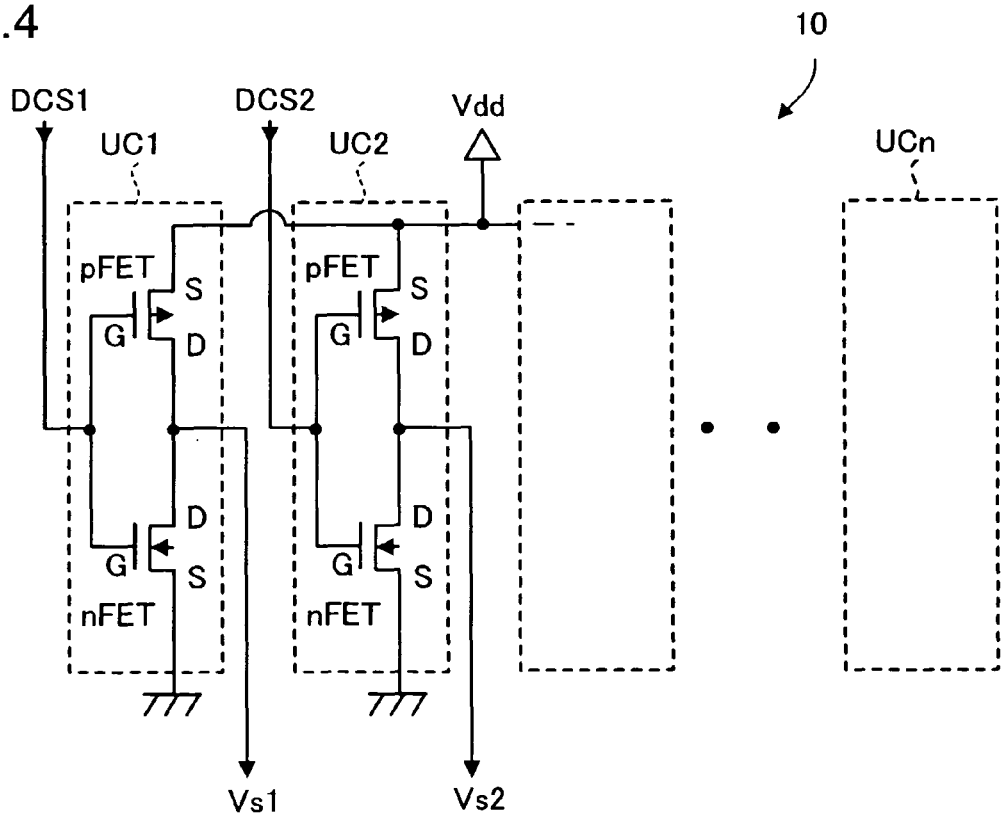
FIG. 4 is a circuit diagram of a drive circuit to be used for the liquid jet head according to the embodiment of the present invention.

FIG. 4 is a circuit diagram illustrating an example of the drive circuit 10 of the liquid jet head 1 according to the embodiment of the present invention. The drive circuit 10 includes as many unit drive circuits UC1, UC2, . . . as the discharge channels 2 (in FIG. 4, n unit drive circuits). Drive control signals DCS1, DCS2, . . . are input from the control circuit 11 to the unit drive circuits UC1, UC2, . . . , and the unit drive circuits UC1, UC2, . . . output drive signals Vs1, Vs2, . . . to the drive electrodes 5*a* and 5*b* of the dummy channels 3*a* and 3*b*, respectively. The unit drive circuits UC1, UC2, . . . are each constituted by a complementary switching circuit in which the P-channel FET (pFET) and the N-channel FET (nFET) are connected in series. A high voltage Vdd is input to the source S of the P-channel FET, the source S of the N-channel FET is connected to the GND, and the drain D of the P-channel FET and the drain D of the N-channel FET are connected to each other to constitute an output terminal. The gate G of the P-channel FET and the gate G of the N-channel FET are connected to each other, and the drive control signal DCS is input thereto from the control circuit 11.

At the time of driving, the drive control signal DCS at H level is input from the control circuit 11 to the gates G of the P-channel FET and the N-channel FET. Then, the P-channel FET is turned OFF, and the source S and the drain D of the P-channel FET are disconnected from each other. The N-channel FET is turned ON, and the drain D and the source S of the N-channel FET become a connected state therebetween. As a result, the drive signal Vs at GND level is supplied to the two drive electrodes 5*a* and 5*b*. At this time, the voltage at GND level is applied to the common electrodes 4 of the discharge channel 2, and hence the partition walls 8*a* and 8*b* of the discharge channel 2 are not deformed, with the result that the liquid is not discharged from the nozzle 9. The drive control signal DCS at L level is input from the control circuit 11 to the gates G of the P-channel FET and the N-channel FET. Then, the P-channel FET is turned ON, and the source S and the drain D of the P-channel FET become a connected state therebetween. The N-channel FET is turned OFF, and the source S and the drain D of the N-channel FET are disconnected from each other. As a result, the drive signal Vs of the high voltage Vdd is supplied to the two drive electrodes 5*a* and 5*b*. The common electrodes 4 of the discharge channel 2 are maintained at GND level, and hence an electric field is applied to the partition walls 8*a* and 8*b* of the discharge channel 2, with the result that the partition walls 8*a* and 8*b* are deformed.

Then, similarly to the above, the drive control signal DCS at H level is input from the control circuit 11 to the gates G of the P-channel FET and the N-channel FET to cancel the electric field of the partition walls 8*a* and 8*b*, and when the partition walls 8*a* and 8*b* are shaped back to the original flat partition walls, the liquid is discharged from the nozzle 9. In this manner, each unit drive circuit UC drives the corresponding discharge channel 2 in accordance with the potential level of the drive control signal DCS input from the control circuit 11. Such a state is the normal drive operation state.

At the time of restoration drive, on the other hand, the control circuit 11 applies the drive control signals DCS at H level to the respective unit drive circuits UC to simultaneously set the drive electrodes 5*a* and 5*b* of the respective dummy channels 3 to the GND level. At the same time, the control circuit 11 applies the control signal CS at L level to the switching element SW to raise the voltage of the output terminal COM to the restoration voltage Vx. Such a state is the restoration operation state, in which the piezoelectric body is subjected to the restoration processing.

Figure 5:
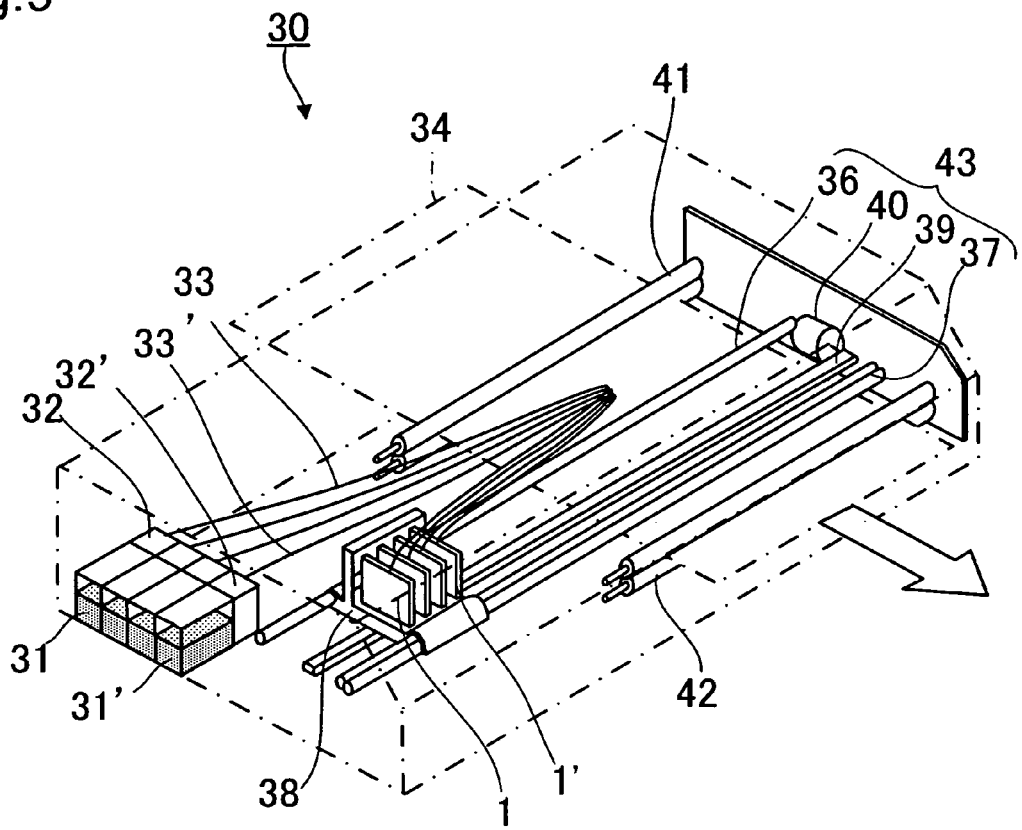
FIG. 5 is a schematic perspective view of a liquid jet apparatus using the liquid jet head according to the present invention.
Figure 6A:
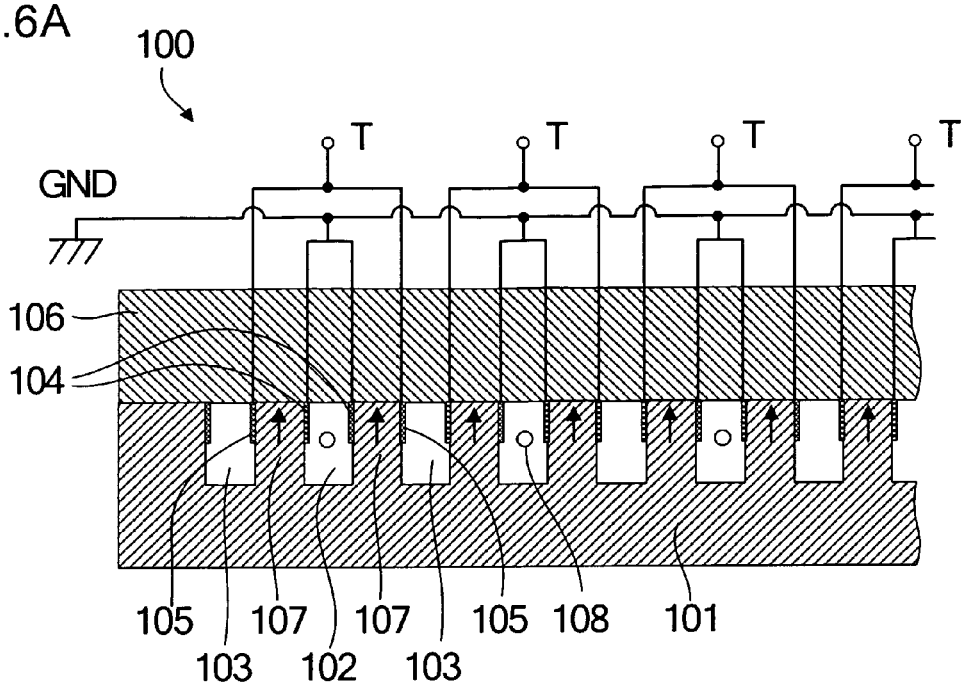
FIGS. 6A and 6B are schematic cross-sectional views of a conventional, publicly-known shear-mode liquid jet head.
Figure 6B:
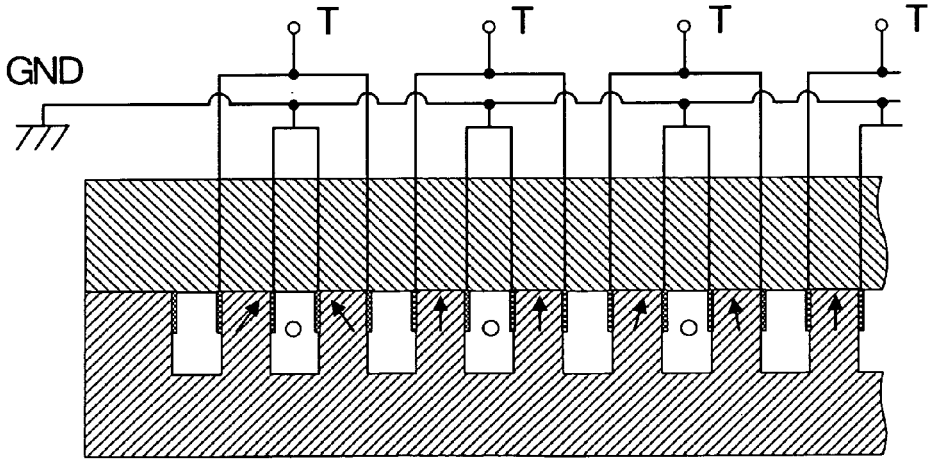

FIG. 5 is a schematic perspective view of a liquid jet apparatus 30 using the liquid jet head 1 according to the present invention.

The liquid jet apparatus 30 includes a moving mechanism 43 for reciprocating liquid jet heads 1 and 1' according to the present invention described above, liquid supply tubes 33 and 33' for supplying liquid to the liquid jet heads 1 and 1', respectively, and liquid tanks 31 and 31' for supplying the liquid to the liquid supply tubes 33 and 33', respectively. The liquid jet heads 1 and 1' are each constituted by the liquid jet head 1 according to the present invention. Specifically, the drive section of the liquid jet head 1 includes the switching element for switching the voltage of the common electrodes of the plurality of discharge channels from the low voltage to the high voltage. Further, the drive section operates in the following manner. At the time of normal drive operation, the voltage of the common electrodes of the plurality of discharge channels is set in common to the low voltage, such as the GND, and the drive signal is supplied individually to the drive electrodes of the plurality of dummy channels. At the time of restoration operation, the voltage of the common electrodes of the plurality of discharge channels is set in common to the high voltage, and the voltage of the drive electrodes of the plurality of dummy channels is set in common to the low voltage, to thereby restore the polarized partition walls.

Specific description is given below. The liquid jet apparatus 30 includes: a pair of transport means 41 and 42 for transporting a recording medium 34 such as paper in a main scanning direction; the liquid jet heads 1 and 1' for discharging liquid onto the recording medium 34; pumps 32 and 32' for pressing the liquid stored in the liquid tanks 31 and 31' to supply the liquid to the liquid supply tubes 33 and 33', respectively; and the moving mechanism 43 for moving the liquid jet heads 1 and 1' to perform scanning in a sub-scanning direction orthogonal to the main scanning direction.

The pair of transport means 41 and 42 each extend in the sub-scanning direction, and include a grid roller and a pinch roller that rotate with their roller surfaces coming into contact with each other. The grid roller and the pinch roller are rotated about their shafts by means of a motor (not shown) to transport the recording medium 34 sandwiched between the rollers in the main scanning direction. The moving mechanism 43 includes a pair of guide rails 36 and 37 extending in the sub-scanning direction, a carriage unit 38 capable of sliding along the pair of guide rails 36 and 37, an endless belt 39 to which the carriage unit 38 is connected and thereby moved in the sub-scanning direction, and a motor 40 for revolving the endless belt 39 through pulleys (not shown).

The carriage unit 38 has the plurality of liquid jet heads 1 and 1' placed thereon, and discharges four kinds of liquid droplets, such as yellow, magenta, cyan, and black. The liquid tanks 31 and 31' store liquid of corresponding colors, and supply the liquid through the pumps 32 and 32' and the liquid supply tubes 33 and 33' to the liquid jet heads 1 and 1', respectively. The liquid jet heads 1 and 1' discharge the liquid droplets of the respective colors in response to a drive voltage. By controlling the timing to discharge the liquid from the liquid jet heads 1 and 1', the rotation of the motor 40 for driving the carriage unit 38, and the transport speed of the recording medium 34, an arbitrary pattern can be recorded on the recording medium 34.

In this structure, the restoration operation can be, for example, carried out at a regular timing when activating the liquid discharge apparatus 30, when cleaning the liquid jet head 1, or when the liquid jet head 1 does not perform the discharge operation, or alternatively, carried out in accordance with the cumulative drive period. In this manner, the unevenness in the liquid jet condition of the respective discharge channels is reduced, and thus the discharge condition of the respective discharge channels can be set uniform.

What is claimed is:

1. A liquid jet head, comprising:

a channel surrounded by wall members at least partially formed of a piezoelectric body that is subjected to polarization processing in one direction;

a pair of electrodes sandwiching the piezoelectric body for applying an electric field in a direction substantially orthogonal to the one direction; and a drive section for driving the piezoelectric body by setting a voltage of one of the pair of electrodes to a low voltage having a relatively small absolute value, and by supplying a drive signal to the other one of the pair of electrodes;

wherein the drive section comprises a switching element for switching the voltage of the one of the pair of electrodes from the low voltage to a high voltage having a relatively large absolute value;

wherein the channel comprises a plurality of discharge channels and a plurality of dummy channels alternately arranged on a surface of a substrate, the plurality of discharge channels and plurality of dummy channels being spaced apart from each other through the intermediation of a plurality of partition walls formed of the piezoelectric body;

wherein the one direction comprises a direction normal to the surface of the substrate;

wherein the pair of electrodes comprises a plurality of pairs of electrodes each having a common electrode and a drive electrode, the plurality of common electrodes being disposed on respective side surfaces of the plurality of partition walls on the discharge channel side, and the plurality of drive electrodes being disposed on respective side surfaces of the plurality of partition walls on the dummy channel side;

wherein the drive section drives the plurality of partition walls by setting a voltage of the plurality of common electrodes in common to the low voltage, and by supplying the drive signal individually to the plurality of drive electrodes; and wherein the drive section applies an electric field exceeding a coercive field of the piezoelectric body to the plurality of partition walls between the plurality of common and drive electrodes by controlling the switching element to set the voltage of the plurality of the common electrodes in common to the high voltage, and by setting a voltage of the plurality of the drive electrodes in common to the low voltage.

2. A liquid jet head according to claim 1, wherein each discharge channel is formed of an elongated groove having a width ranging from 30 μm to 50 μm, and wherein a thickness of each partition wall in an arrangement direction in which the corresponding discharge channel and dummy channel are arranged ranges from 30 μm to 50 μm.

3. A liquid jet head according to claim 1, wherein the switching element comprises a complementary circuit in which a P-channel field effect transistor and an N-channel field effect transistor are connected in series.

4. A liquid jet apparatus, comprising:

the liquid jet head according to claim 1;

a moving mechanism for reciprocating the liquid jet head;

a liquid supply tube for supplying liquid to the liquid jet head; and a liquid tank for supplying the liquid to the liquid supply tube.

5. A method of driving a liquid jet head, the liquid jet head comprising:

a channel surrounded by wall members at least partially formed of a piezoelectric body that is subjected to polarization processing in one direction, the channel comprising a plurality of discharge channels and a plurality of dummy channels alternately arranged on a surface of a substrate, the plurality of discharge channels and plurality of dummy channels being spaced apart from each other through the intermediation of a plurality of partition walls formed of the piezoelectric body, and the one direction comprising a direction normal to the surface of the substrate;

a plurality of pairs of electrodes sandwiching the piezoelectric body for applying an electric field in a direction substantially orthogonal to the one direction, each pair of electrodes having a common electrode and a drive electrode, the plurality of common electrodes being disposed on respective side surfaces of the plurality of partition walls on the discharge channel side, and the plurality of drive electrodes being disposed on respective side surfaces of the plurality of partition walls on the dummy channel side; and a drive section for driving the piezoelectric body;

the method comprising:

driving, by the drive section, at a time of driving, the piezoelectric body by setting a voltage of the plurality of common electrodes in common to a first low voltage having a relatively small absolute value, and by supplying a drive signal of one polarity individually to the plurality of drive electrodes;

restoring, by the drive section, at a time of restoration, the piezoelectric body by setting the voltage of the plurality of common electrodes to a high voltage having the same one polarity as the drive signal and having a relatively large absolute value, and setting a voltage of the plurality of drive electrodes to a second low voltage having a relatively small absolute value; and applying, by the drive section, at the time of restoration, a voltage for generating an electric field exceeding a coercive field of the piezoelectric body to the plurality of pairs of electrodes.

6. A method of driving a liquid jet head, comprising:

providing a liquid jet head having a channel surrounded by wall members at least partially formed of a piezoelectric body that is subjected to polarization processing in one direction, a pair of electrodes sandwiching the piezoelectric body for applying an electric field in a direction substantially orthogonal to the one direction, and a drive section for driving the piezoelectric body;

driving, by the drive section, at a time of driving, the piezoelectric body by setting a voltage of one of the pair of electrodes to a first low voltage having a relatively small absolute value, and by supplying a drive signal of one polarity to the other of pair electrodes;

restoring, by the drive section, at a time of restoration, the piezoelectric body by setting the voltage of the one of the electrodes to a high voltage having the same one polarity as the drive signal and having a relatively large absolute value, and by setting a voltage of the other of the electrodes to a second low voltage having a relatively small absolute value; and applying, by the drive section, at the time of restoration, a voltage for generating an electric field exceeding a coercive field of the piezoelectric body to the pair of electrodes.

7. A method according to claim 6, wherein the providing step comprises providing the liquid jet head so that each discharge channel is formed of an elongated groove having a width ranging from 30 μm to 50 μm, and a thickness of each partition wall in an arrangement direction in which the corresponding discharge channel and dummy channel are arranged ranges from 30 μm to 50 μm.

8. A method according to claim 6, wherein the providing step comprises providing the liquid jet head the switching element that comprises a complementary circuit in which a P-channel field effect transistor and an N-channel field effect transistor are connected in series.

* * * * *